US010195656B2

(12) United States Patent
Fukuchi et al.

(10) Patent No.: US 10,195,656 B2
(45) Date of Patent: Feb. 5, 2019

(54) COOLING METHOD FOR HOT PRESS FORMING AND HOT PRESS FORMING APPARATUS

(71) Applicant: NIPPON STEEL & SUMITOMO METAL CORPORATION, Tokyo (JP)

(72) Inventors: Hiroshi Fukuchi, Tokyo (JP); Naruhiko Nomura, Tokyo (JP); Atsushi Seto, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 331 days.

(21) Appl. No.: 14/907,730

(22) PCT Filed: Sep. 11, 2014

(86) PCT No.: PCT/JP2014/074056
§ 371 (c)(1),
(2) Date: Jan. 26, 2016

(87) PCT Pub. No.: WO2015/037657
PCT Pub. Date: Mar. 19, 2015

(65) Prior Publication Data

US 2016/0167101 A1 Jun. 16, 2016

(30) Foreign Application Priority Data

Sep. 12, 2013 (JP) ..... 2013-189218

(51) Int. Cl.
*B21D 37/16* (2006.01)
*B21D 22/02* (2006.01)
*B21D 22/20* (2006.01)

(52) U.S. Cl.
CPC ..... *B21D 37/16* (2013.01); *B21D 22/022* (2013.01); *B21D 22/208* (2013.01)

(58) Field of Classification Search
CPC .... B21D 22/022; B21D 22/20; B21D 22/208; B21D 22/286; B21D 37/16; C21D 1/673
See application file for complete search history.

(56) References Cited

U.S. PATENT DOCUMENTS

2007/0017272 A1* 1/2007 Kurisu ..... B21D 22/022 72/342.2
2009/0013749 A1* 1/2009 Ishimori ..... B21D 22/02 72/342.2

(Continued)

FOREIGN PATENT DOCUMENTS

CN 102492806 A 6/2012
JP 2002-102979 A 4/2002

(Continued)

OTHER PUBLICATIONS

JP 2011-14347 A was filed with the Information Disclosure Statement on Jan. 26, 2016 and is already of record in the present application.

(Continued)

*Primary Examiner* — Edward Tolan
(74) *Attorney, Agent, or Firm* — Birch, Stewart, Kolasch & Birch, LLP

(57) ABSTRACT

In hot press forming a thin steel sheet K, when cooling the thin steel sheet K by supplying a refrigerant to an ejection hole (27) communicated from a supply path (28) inside a lower mold (12), precooling in which an ejection amount per unit time period of the refrigerant from the ejection hole (27) is suppressed is carried out, and thereafter, main cooling is carried out by increasing the ejection amount per unit time period.

10 Claims, 6 Drawing Sheets

(56) References Cited

U.S. PATENT DOCUMENTS

| | | | | |
|---|---|---|---|---|
| 2011/0219843 | A1 | 9/2011 | Kurisu et al. | |
| 2011/0219848 | A1 | 9/2011 | Kurisu et al. | |
| 2011/0219849 | A1 | 9/2011 | Kuriso et al. | |
| 2011/0232354 | A1* | 9/2011 | Hielscher | B21D 37/16 72/364 |
| 2012/0260784 | A1 | 10/2012 | Saito et al. | |
| 2013/0205862 | A1* | 8/2013 | Takahashi | B21D 22/286 72/342.3 |
| 2014/0069162 | A1* | 3/2014 | Fukuchi | B21D 22/208 72/342.2 |
| 2014/0123721 | A1 | 5/2014 | Ishii | |
| 2014/0305181 | A1* | 10/2014 | Kobayashi | B21D 22/208 72/342.5 |

FOREIGN PATENT DOCUMENTS

| | | | |
|---|---|---|---|
| JP | 2011-143437 | A | 7/2011 |
| JP | 2011-161481 | A | 8/2011 |
| JP | 2012-143781 | A | 8/2012 |
| JP | 2012-218067 | A | 11/2012 |
| KR | 10-2006-0054479 | | 5/2006 |
| WO | WO 2013/001630 | A1 | 1/2010 |

OTHER PUBLICATIONS

Korean Office Action dated Jan. 11, 2017, issued in corresponding Korean Patent Application No. 10-2016-7003258.

Office Action dated Jan. 24, 2017 in Canadian Patent Application No. 2,919,823.

Chinese Office Action and Search Report, dated Sep. 26, 2016, for corresponding Chinese Application No. 201480048321.7, with a partial English translation.

International Search Report, Issued in PCT/JP2014/074056, dated Nov. 25, 2014.

Written Opinion of the International Searching Authority, Issued in PCT/JP2014/074056, dated Nov. 25, 2014

International Preliminary Report on Patentability and Written Opinion of the International Searching Authority (Forms PCT/IB/338, PCT/IB/373 and PCT/ISA/237) dated Mar. 24, 2016, for international Application No. PCT/JP2014/074056.

* cited by examiner

COOLING METHOD FOR HOT PRESS FORMING AND HOT PRESS FORMING APPARATUS

TECHNICAL FIELD

The present invention relates to a cooling method for hot press forming of a thin steel sheet and to a hot press forming apparatus.

BACKGROUND ART

Hot press forming is recently adopted as a steel sheet forming means for an automobile component or the like using a high-tensile steel sheet. In hot press forming, as a result of press forming a steel sheet at a high temperature, forming is carried out in a stage where a deformation resistance is low, and quench hardening by rapid cooling is done, and therefore, it is possible to obtain a component or the like which has a high strength and a high shape accuracy, without generating a forming defect such as a deformation after forming.

In hot press forming, a steel sheet having been heated to a predetermined temperature by a heating furnace in advance is supplied to a mold, and in a state where the steel sheet is placed on a die or floated by a jig such as a lifter built in the mold, a punch is lowered to a bottom dead center, and then a refrigerant such as water, for example, is supplied to between the steel sheet and the mold to cool the steel sheet rapidly. Therefore, a surface of the mold is provided with a plurality of independent projecting portions with a constant height and the inside of the mold is provided with a channel of water communicated with ejection holes of the refrigerant which are provided in a plurality of places in the surface of the mold and a channel for sucking the supplied water. In a conventional cooling method for hot press forming of a thin steel sheet, since the same flow amount is kept while cooling is carried out by flowing cooling water, the same ejection amount is ejected from each ejection hole during a cooling time period.

In a case where hot press forming is carried out by using a mold of such a configuration, it is considered to shorten a cooling time period by increasing a flow amount of cooling water, in order to further improve a productivity. However, it is found that a variation of qualities such as a formed shape (warpage) and a quenching characteristic occurs depending on a region. This is caused by nonuniformity of cooling due to a difference in cooling speed by the flow of the refrigerant in a neighborhood of the ejection hole and its periphery. In other words, the difference in cooling speed generates a thermal stress, which causes the quality to vary. Further, as a result of further study by the inventors, it is found that there is cooling unevenness in a circular state centering on the ejection hole. It is considered that if cooling water is ejected at a predetermined ejection amount from the beginning of cooling, bumping or entrainment of air occurs concentrically centering on the ejection hole, thereby to generate cooling unevenness. Therefore, a device of some kind is necessary with regard to an amount supplied of the refrigerant.

Note that the applicant has already suggested a hot press forming method of Patent Literature 1 with regard to supply control of a refrigerant in a hot press forming method. In the above hot press forming method, a heated thick steel sheet is placed on a rapid cooling mold, the refrigerant is supplied to the thick steel sheet to carry out rapid cooling while the rapid cooling mold is held at a bottom dead center, and thereafter, supply of the refrigerant is controlled in a state where the rapid cooling mold is held at the bottom dead center. More specifically, stopping of supply of the refrigerant and conducting supply of the refrigerant again after a predetermined time period passes is repeated at least once or more, or a predetermined supply flow amount of the refrigerant is once reduced halfway and the supply flow amount of the refrigerant is increased again after a predetermined time period passes.

However, in the hot press forming method of Patent Literature 1, a target steel sheet is what is called a thick sheet and an object thereof is to make a formed product in which a strength is changed in a thickness direction of the steel sheet. Therefore, without a countermeasure, in hot press forming of a thin steel sheet, it is impossible to improve a distortion of a shape of the steel sheet or quality unevenness caused by nonuniformity of cooling due to the aforementioned difference in cooling speed which occurs in a neighborhood of an ejection hole and its periphery.

CITATION LIST

Patent Literature

Patent Literature 1: Japanese Laid-open Patent Publication No. 2011-143437

SUMMARY OF INVENTION

Technical Problem

The present invention is made in view of the above circumstances, and an object thereof is to suppress a distortion of a shape and a variation of a quality caused by nonuniformity of cooling, in hot press forming a thin steel sheet.

Solution to Problem

As a result of keen study and experiments by the inventors it is proved that a distortion of a shape or the like due to nonuniformity of cooling is caused by occurrence of a temperature variation as a result of cooling being promptly carried out in a neighborhood of an ejection hole of a refrigerant while a cooling speed becoming slow at a position apart from the ejection hole. Further, it is newly found that such a variation changes by change of a flow amount of the supplied refrigerant.

In view of the above findings, the present invention is a cooling method for hot press forming in which a thin steel sheet is cooled by supplying a refrigerant to an ejection hole of a surface of a mold which ejection hole is communicated from a supply path inside the mold in hot press forming the heated thin steel sheet, the cooling method for hot press forming including: carrying out precooling in which an ejection amount per unit time period of the refrigerant from the ejection hole is suppressed; and thereafter, carrying out main cooling by increasing the ejection amount per unit time period, when the thin steel sheet is cooled by supplying the refrigerant to the ejection hole in a state where the heated thin steel sheet is placed on the mold and held at a bottom dead center.

Further, the present invention is a hot press forming apparatus which cools a thin steel sheet by supplying a refrigerant to an ejection hole of a surface of a mold which ejection hole is communicated from a supply path inside the mold in hot press forming the heated thin steel sheet, the hot press forming apparatus carrying out precooling in which an ejection amount per unit time period is suppressed, and thereafter, carrying out main cooling by increasing the ejection amount per unit time period of the refrigerant from the ejection hole, when the thin steel sheet is cooled by supplying the refrigerant to the ejection hole in a state where the heated thin steel sheet is placed on the mold and held at a bottom dead center.

By carrying out the precooling in which the ejection amount per unit time period is suppressed as described above, it is possible to suppress excessive cooling in a neighborhood of the ejection hole. Further, by carrying out the precooling in which the ejection amount per unit time period is suppressed, it is possible to suppress bumping or entrainment of air of the beginning of the cooling. Therefore, by main cooling thereafter, uniform cooling can be materialized to an entire of the thin steel sheet.

Advantageous Effects of Invention

According to the present invention, it is possible to suppress a distortion of a shape or a variation of a quality caused by nonuniformity of cooling in hot press forming a thin steel sheet.

DESCRIPTION OF EMBODIMENTS

Hereinafter, an embodiment of the present invention will be described.

Figure 1:
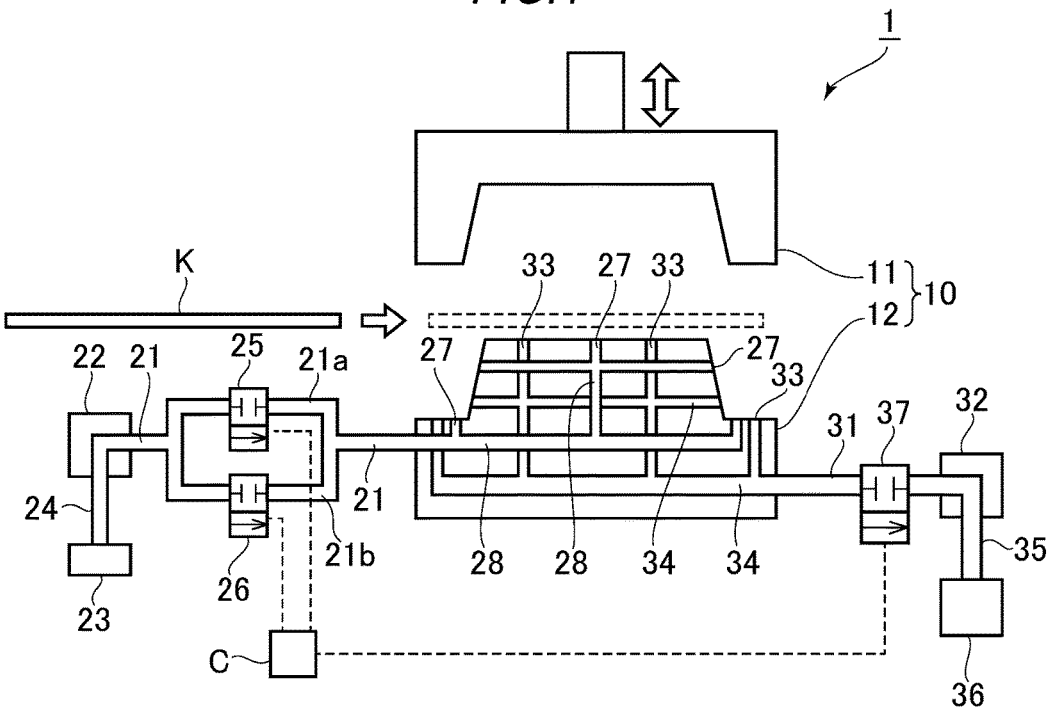
FIG. 1 is a diagram schematically showing a configuration of a hot press forming apparatus.

FIG. 1 is a diagram schematically showing a configuration of a hot press forming apparatus 1 of the present embodiment. The hot press forming apparatus 1 has an upper mold 11 (first mold) and a lower mold 12 (second mold) which constitute a press forming mold 10 for press forming a steel sheet (thin steel sheet) K. Note that the thin steel sheet means a steel sheet with a sheet thickness of less than 3 mm.

In the present embodiment, a plurality of independent projecting portions (not shown) with a constant height are provided in a surface of the lower mold 12, and gaps are made between the steel sheet K and the lower mold 12 at a bottom dead center. Cooling water as a refrigerant is supplied into the gaps. The upper mold 11 can be raised and lowered freely in a vertical direction at a predetermined pressure by a raising and lowering mechanism (not shown). Note that the steel sheet K is heated to a predetermined temperature, for example, to a temperature of 700° C. or more to 1000° C. or less by a heating apparatus (not shown) in advance, and is conveyed to the hot press forming apparatus 1. The conveyed steel sheet is placed at a predetermined position of the lower mold 12 based on a positioning pin (not shown) set in a predetermined position of the lower mold 12, for example.

To the lower mold 12 are connected/installed a supply pipe 21 of the cooling water to be the refrigerant and a suction pipe 31 to suck surplus cooling water. The supply pipe 21 is to supply the cooling water into the lower mold 12 at a predetermined pressure by a supply pump 22. The suction pipe 31 is to discharge the cooling water which has been supplied to between the lower mold 12 and the steel sheet K to the outside of the apparatus by a suction pump 32.

The supply pump 22 intakes the cooling water from a cooling water supply source 23 through an intake pipe 24. The intake pipe 24 is connected to the supply pipe 21 in a downstream side of the supply pump 22. The supply pipe 21 is branched into a first branch pipe 21*a* and a second branch pipe 21*b* in a downstream side of a connected portion to the intake pipe 24. The first branch pipe 21*a* and the second branch pipe 21*b* are a plurality of supply systems of the refrigerant to the supply pipe 21. The first branch pipe 21*a* and the second branch pipe 21*b* are provided with opening/closing valves 25, 26 of a supply side having a good responsibility, in correspondence therewith, respectively. The first branch pipe 21*a* and the second branch pipe 21*b* are joined again in a downstream side of the opening/closing valves 25, 26. The supply pipe 21 is communicated with a plurality of ejection holes 27 provided in the surface of the lower mold 12, through a supply path 28 made inside the lower mold 12.

Further, a plurality of suction holes 33 are provided in the surface of the lower mold 12. The suction hole 33 leads to a suction path 34 made inside the lower mold 12 and is communicated with the suction pipe 31. The cooling water sucked by the suction pump 32 is discharged to a discharge portion 36 from the suction pipe 31 through the discharge pipe 35. The suction pipe 31 is provided with an opening/closing valve 37 of a suction side.

Opening/closing of the opening/closing valves 25, 26 of the supply side and opening/closing of the opening/closing valve 37 of the suction side are controlled together with an action of the upper mold 11 by a control device C.

Figure 2:
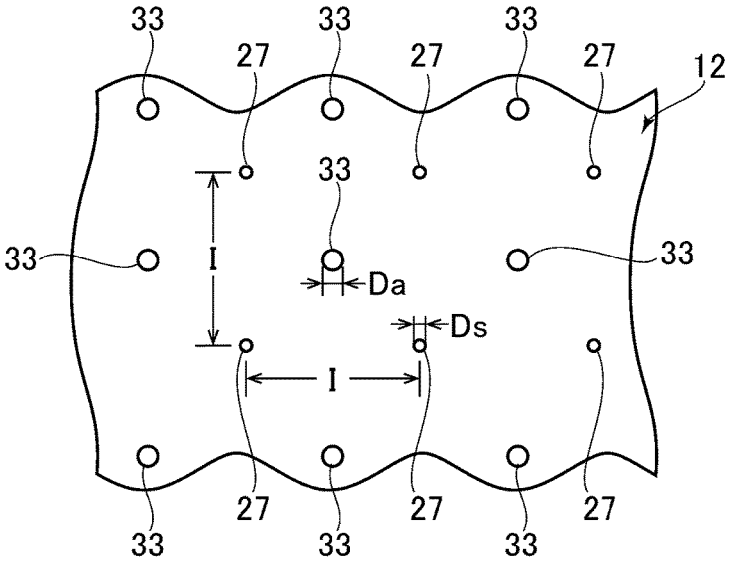
FIG. 2 is a diagram showing an example of disposition of ejection holes and suction holes.

FIG. 2 is a diagram showing an example of disposition of the ejection holes 27 and the suction holes 33 made in the lower mold 12. Note that the projecting portion is omitted in FIG. 2. As shown in FIG. 2, the plurality of ejection holes 27 with a diameter Ds are made at an interval I in the surface of the lower mold 12. Further, the suction hole 33 with a diameter Da is made in a center of four ejection holes 27 positioned rectangularly. Therefore, almost the same numbers of the ejection holes 27 and suction holes 33 are made in the lower mold 12.

In the present embodiment, the diameter Da of the suction hole 33 is made larger than the diameter Ds of the ejection hole 27. As a result of making the diameter Da of the suction hole 33 larger, it is possible to suck the cooling water after cooling from the suction hole 33 without accumulation even if the ejection amount from the ejection hole 27 increases. Further, as a result of making the diameter Da of the suction hole 33 larger, the cooling water ejected from the plurality of ejection holes 27 sucked from the suction hole 33 without accumulation even if the cooling water gathers to one suction hole 33.

In the aforementioned hot press forming apparatus 1 of the embodiment, the supply pipe 21 is branched into the first branch pipe 21*a* and the second branch pipe 21*b* halfway, the opening/closing valve 25 is provided in the first branch pipe 21*a*, the opening/closing valve 26 is provided in the second branch pipe 21*b*, and the opening/closing valve 37 is provided also in the suction pipe 31, but it should be noted that the present invention is not limited to the above configuration.

Figure 3:
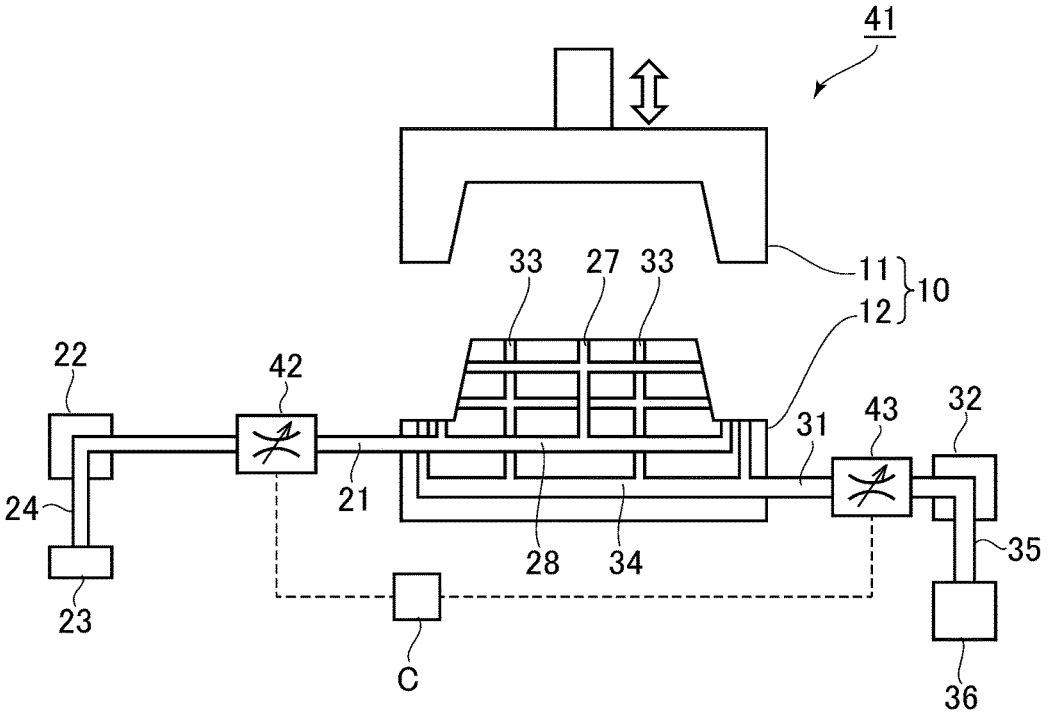
FIG. 3 is a diagram schematically showing a configuration of a hot press forming apparatus having a flow amount regulation valve.

FIG. 3 is a diagram schematically showing a configuration of a hot press forming apparatus 41. In the hot press forming apparatus 41, a supply pipe 21 is not branched, the supply pipe 21 being provided with a flow amount regulation valve 42 such as a ball valve which can regulate a flow amount in correspondence with an opening degree of the valve, and a suction pipe 31 is also similarly provided with a flow amount regulation valve 43. In this way, the flow amount regulation valve may be used instead of the opening/closing valve.

Next, an operation example of the hot press forming apparatus 1 shown in FIG. 1 will be described.

Figure 4:
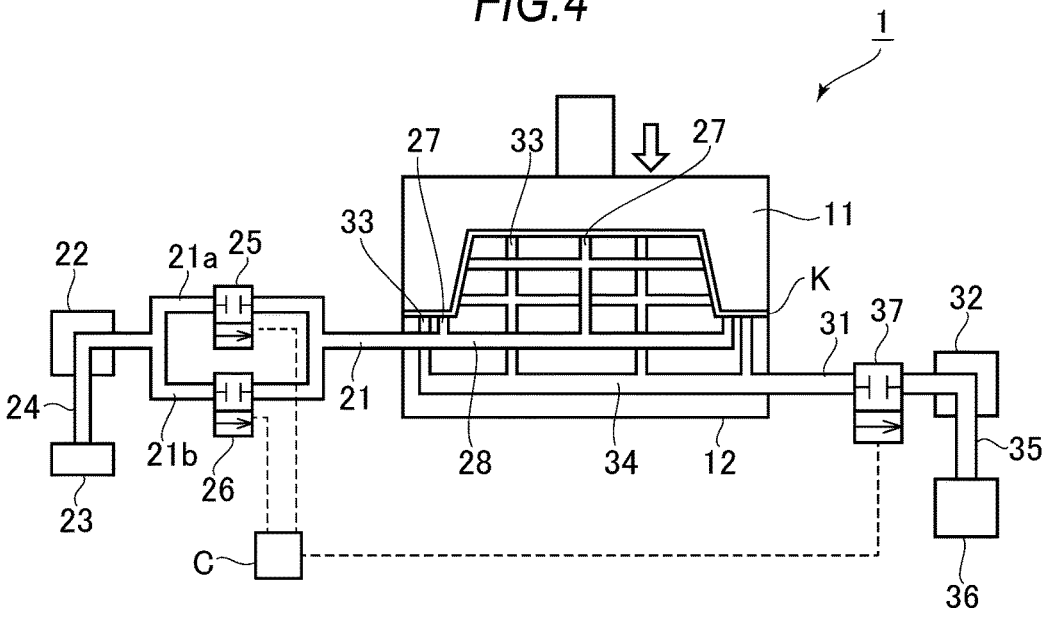
FIG. 4 is a diagram showing a state where an upper mold of the hot press forming apparatus of FIG. 1 is at a bottom dead center.

First, a steel sheet K having been heated to 900° C., for example, in advance is placed at a predetermined position of the lower mold 12 by a delivery unit (not shown). Next, as shown in FIG. 4, the upper mold 11 is lowered to the bottom dead center while pushing down the steel sheet K vertically downward, so that forming of the steel sheet K is carried out. At this time, the supply pump 22 and the suction pump 32 already work.

The upper mold 11 is held at a time that the upper mold 11 is lowered to the bottom dead center while pushing down the steel sheet K vertically downward, and first, the opening/closing valve 25 is opened, so that cooling water of a predetermined flow amount is supplied from the first branch pipe 21*a* and the supply pipe 21 to the supply path 28 inside the lower mold 12. Therefore, the cooling water is ejected/supplied from the ejection hole 27 into the gap between the steel sheet K and the surface of the lower mold 12 (precooling). Then, the opening/closing valve 37 of the suction side is also opened. Here, at a time of precooling, since the opening/closing valve 26 is kept closed, an ejection amount per unit time period from the ejection hole 27 is suppressed compared with a time of main cooling which will be described later. The cooling water supplied into the gap between the steel sheet K and the lower mold 12 takes heat from the steel sheet K, and part thereof is vaporized and dispersed from a gap between the upper mold 11 and the lower mold 12. The remaining cooling water is discharged to the outside of the apparatus, from the suction hole 33 through the suction path 34 and via the suction pipe 31.

Next, after a predetermined time period passes, the opening/closing valve 26 of the supply side is opened while the opening/closing valve 25 is kept in a state of being opened. Therefore, in addition to the cooling water from the first branch pipe 21*a*, cooling water from the second branch pipe 21*b* is also supplied, so that the flow amount of the cooling water supplied to the supply path 28 is increased. Therefore, the ejection amount per unit time period of the cooling water ejected from the ejection hole 27 is increased by that amount (main cooling).

Next, after a predetermined time period passes and the steel sheet K is cooled to a predetermined temperature, the opening/closing valves 25, 26 are closed, and the opening/closing valve 37 is also closed.

Note that in a cooling process as above, it is preferable that an ejection amount of precooling is 1.0 mL/sec by each ejection hole to 3.0 mL/sec by each ejection hole. Further, it is preferable that a ratio of a flow amount flowing from only the first branch pipe 21*a* when only the opening/closing valve 25 is in the state of being opened at a time of precooling to a flow amount flowing from both the first branch pipe 21*a* and the second branch pipe 21*b* by opening both the opening/closing valves 25, 26 at a time of main cooling thereafter is 1:5 to 2:5. Therefore, it is preferable that a ratio of the ejection amount per unit time period of the cooling water ejected from the ejection hole 27 at the precooling time to the ejection amount per unit time period of the cooling water ejected from the ejection hole 27 at the main cooling time is 1:5 to 2:5.

Further, it is preferable that a ratio of the precooling time, that is, a time period during which flowing is done only from the first branch pipe 21*a* to the main cooling time, that is, a time period during which flowing is done from both the first branch pipe 21*a* and the second branch pipe 21*b* is 1:4 to 4:1. Therefore, it is preferable that a ratio of the precooling time period to the main cooling time period is 1:4 to 4:1. Here, when a total time period from the start of cooling to the stop of cooling is indicated as T, the main cooling time period is preferable to be T/5 to 4T/5 from the start. Further, the main cooling time period is preferable to be 1 second to 4 seconds.

By the flow amount control of the cooling water as above, there become possible the precooling where the amount supplied of the cooling water from the ejection hole 27 is the flow amount from only the first branch pipe 21*a* at the beginning of the cooling and subsequently the main cooling where the cooling water is supplied from both the first branch pipe 21*a* and the second branch pipe 21*b*. Therefore, it is possible to carry out the precooling in which the ejection amount per unit time period is suppressed. By carrying out the precooling, rapid cooling is suppressed in the neighborhood of the ejection hole at the beginning of the cooling, and as a result of being cooled gradually, a temperature difference in the neighborhood of the ejection hole and in a position apart from the ejection hole can be decreased. Further, as a result of being cooled gradually, it is possible to suppress bumping or entrainment of air at the beginning of the cooling.

Therefore, it is possible to suppress a distortion of a shape of a steel sheet or quality unevenness caused by temperature unevenness.

Figure 5:
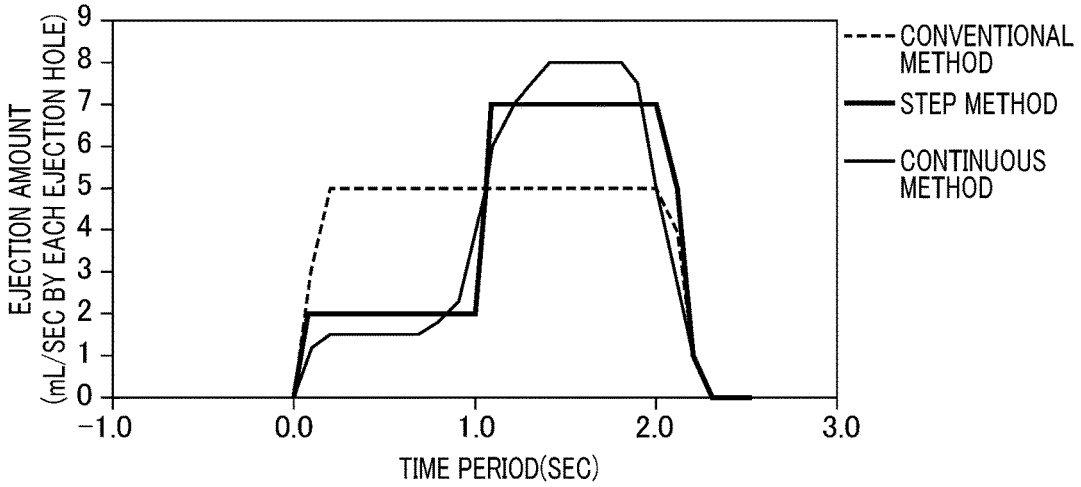
FIG. 5 is a graph showing an example of flow amount control of cooling water.

Next, an ejection amount control example of the cooling water of the hot press forming apparatuses 1, 41 of the present embodiment will be described with reference to FIG. 5. FIG. 5 shows fluctuation of each ejection amount of a conventional method, a step method, and a continuous method.

In the conventional method, the same ejection amount is maintained from the beginning until the stop of supply of cooling water. The step method is an operational example of the hot press forming apparatus 1 of FIG. 1. The continuous method is an operational example of the hot press forming apparatus 41 of FIG. 3.

As shown in FIG. 5, in the step method (hot press forming apparatus 1 of FIG. 1), from a cooling start time at the bottom dead center (position of 0.0 in a horizontal axis in a graph of FIG. 5) until 1 second passes, only the opening/closing valve 25 is opened and supply is carried out at an ejection amount of 2 mL/sec by each ejection hole (precooling). Thereafter, until 2 seconds pass, the opening/closing valve 26 is also opened, and supply is carried out at an ejection amount of 7 mL/sec by each ejection hole in total (main cooling).

Further, in the continuous method (hot press forming apparatus 41 of FIG. 3), the flow amount regulation valve 42 is controlled and from a cooling start time until 0.8 seconds pass, supply is carried out at an ejection amount of 1.5 mL/sec by each ejection hole (precooling). Thereafter, from a time that 0.8 seconds have passed, an opening degree of the flow amount regulation valve 42 is made gradually large to increase the flow amount, the opening degree being made gradually large until 1.4 seconds pass. Thereafter, until 1.8 seconds pass, supply is carried out at an ejection amount of 8.0 mL/sec by each ejection hole at a maximum opening degree (main cooling). Thereafter, the flow amount regulation valve 42 is gradually closed, and at a time that 2.0 seconds pass, the flow amount regulation valve 42 is closed.

Figure 6:
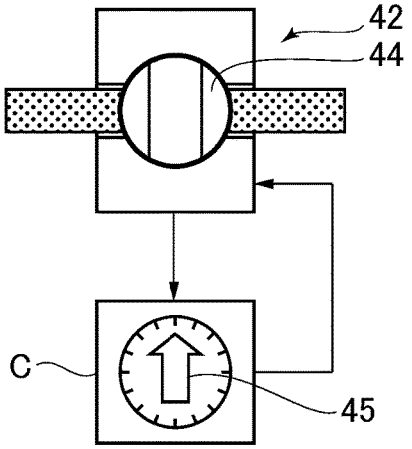
FIG. 6 is a diagram showing a state where an opening degree of the flow amount regulation valve is fully closed.
Figure 7:
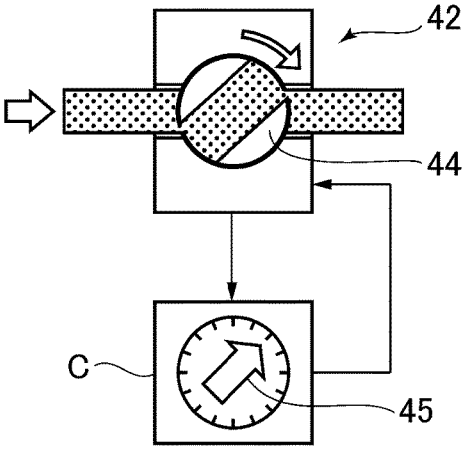
FIG. 7 is a diagram showing a state where the opening degree of the flow amount regulation valve is medium.
Figure 8:
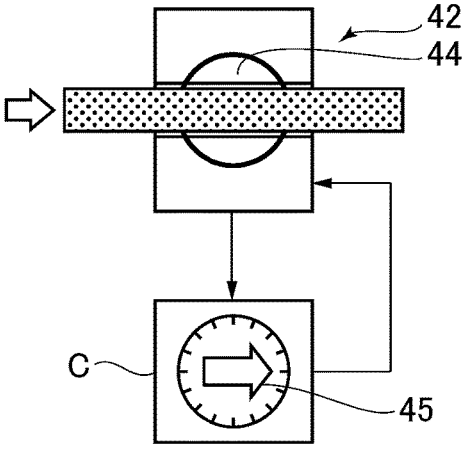
FIG. 8 is a diagram showing a state where the opening degree of the flow amount regulation valve is fully opened.

Note that as the flow amount regulation valve 42 which can materialize ejection amount control of the continuous method, it is possible to use one shown in FIG. 6 to FIG. 8 which is capable of freely regulating an opening degree of a valve element 44.

FIG. 6 shows a state where the valve element 44 is fully closed. FIG. 7 shows a state where the valve element 44 is in the middle between being fully closed and being fully opened. FIG. 8 shows a state where the valve element 44 is fully opened. The flow amount regulation valve 42 is controlled by a control device C. The control device C detects the opening degree of the valve element 44 via an angle detection sensor (not shown) or the like. As shown in FIG. 6 to FIG. 8, the control device C can indicate the detected opening degree by an arrow 45 or the like, for example. Further, the control device C opens/closes the valve element 44 via a valve opening/closing drive mechanism (not shown) such as an electric motor. More specifically, the control device C can materialize ejection amount control of the continuous method of FIG. 5 by opening/closing the valve element 44 based on a program in which a cooling time period and an opening degree of the valve element 44 are correlated and stored.

As described above, by using the flow amount regulation valve 42 capable of regulating the flow amount continuously, it is possible to moderate ejection of the cooling water at the precooling start time and transition of the ejection amount from the precooling to the main cooling. Further, as a result that the control device C carries out ejection amount control based on the program, an ejection amount pattern of the continuous method of FIG. 5 can be set to be an arbitrary pattern only by changing the program. Therefore, a distortion of a shape of a steel sheet and quality unevenness can be adjusted precisely.

Figure 9:
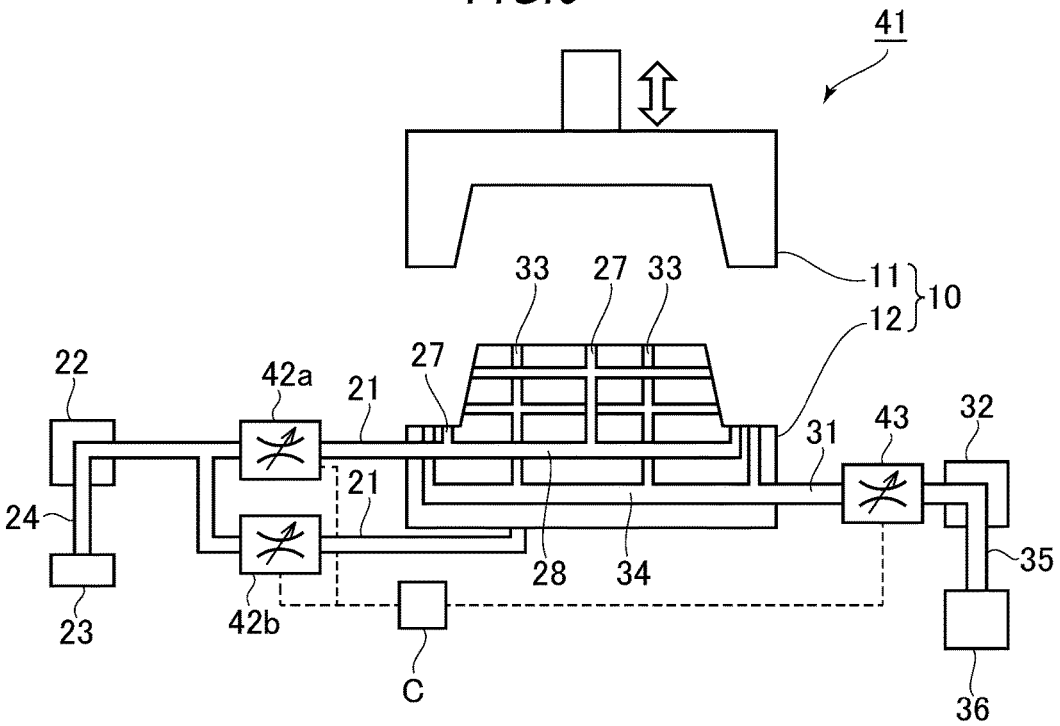
FIG. 9 is a diagram schematically showing a configuration in which a plurality of supply pipes are provided.
Figure 10:
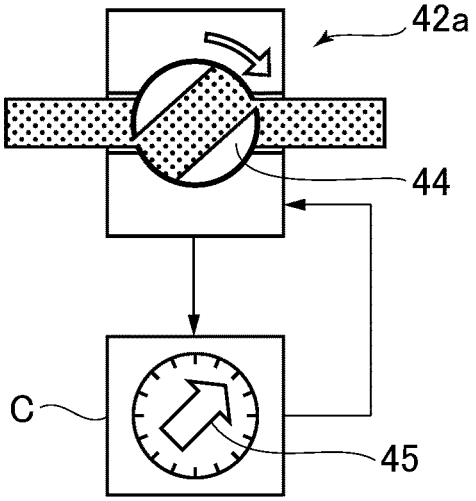
FIG. 10 is a diagram showing a state where the opening degree of the flow amount regulation valve is 45 degrees.
Figure 11:
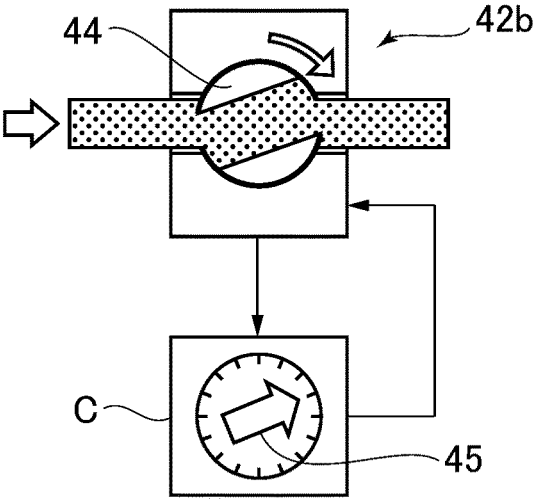
FIG. 11 is a diagram showing a state where the opening degree of the flow amount regulation valve is 22.5 degrees.

Further, the number of the flow amount regulation valve 42 to be provided is not limited to one, but, as shown in FIG. 9, it is possible that a plurality of supply pipes 21 to a mold are provided in parallel and that flow amount regulation valves 42*a*, 42*b* are provided in each of the supply pipes 21. In such a case, it is possible to regulate a flow amount for each supply pipe 21, and for a large mold in particular, the ejection amount pattern of the continuous method can be set to be an arbitrary pattern for each region of the mold. For example, it is possible to change an ejection amount of cooling water for each supply pipe 21 by making an opening degree of a valve element 44 in the flow amount regulation valve 42*a* be 45 degrees as shown in FIG. 10 and making an opening degree of a valve element 44 in the flow amount regulation valve 42*b* be 22.5 degrees as shown in FIG. 11. Therefore, even in a case of carrying out press forming by a large mold, it is possible to suppress a difference in cooling (quenching) characteristic which is generated because a shape is different for each region of the mold. Further, it is possible to obtain a different cooling (quenching) characteristic for each region of the mold by intentionally generating a difference in ejection amount of the cooling water.

Figure 12:
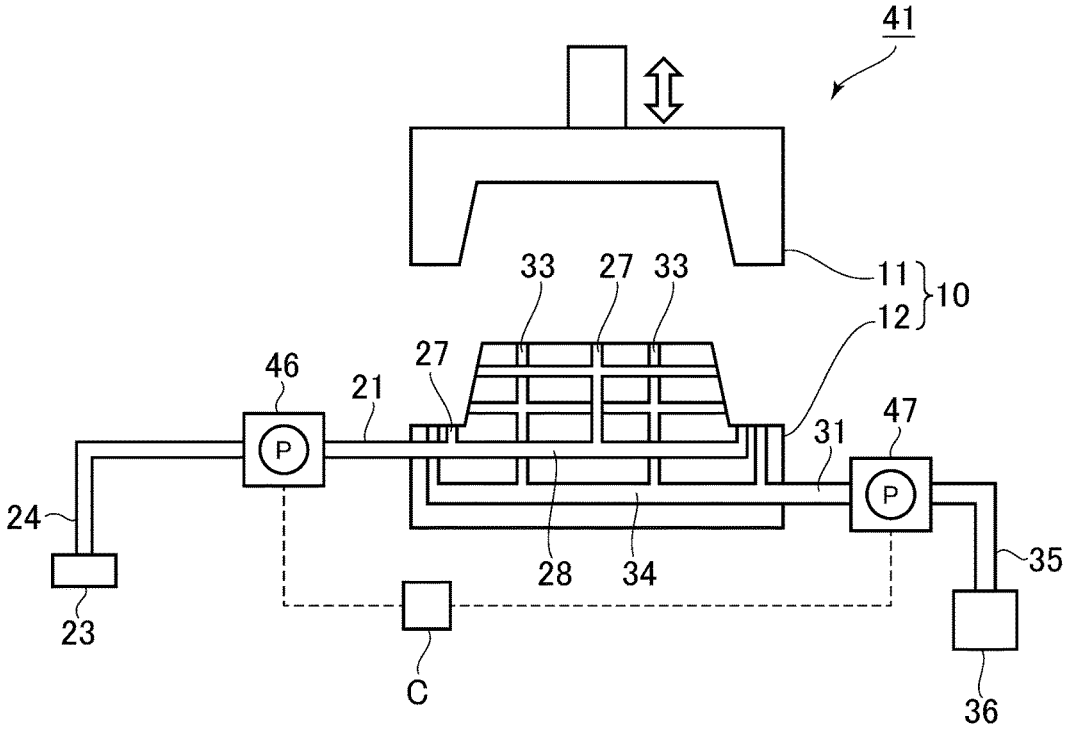
FIG. 12 is a diagram schematically showing a configuration of a hot press forming apparatus having a supply pipe capable of flow amount regulation.

Further, an ejection amount of cooling water of an entire mold may be made uniform by synchronizing or intentionally differentiating opening/closing speeds of a plurality of flow amount regulation valves provided in a supply pipe of cooling water, the supply pipe leading to a supply path inside the mold. In such a case, a control device C controls the plurality of flow amount control valves Further, in a case of a small mold, as shown in FIG. 12, it is possible to use a flow amount regulation type supply pump 46 capable of regulating a supply flow amount and a flow amount regulation type suction pump 47 capable of regulating a suction flow amount. By using the flow amount regulation type supply pump 46, flow amount regulation similar to that by the flow amount regulation valve is possible. As the flow amount regulation type supply pump 46 and the flow amount regulation type suction pump 47, it is possible to use ones in which the numbers of rotation of the pumps are changeable by inverter control, for example. In such a case, a control device C controls the number of rotation of the pump.

As described above, by either of the step method (hot press forming apparatus 1 of FIG. 1) and the continuous method (hot press forming apparatus 41 of FIG. 3), it is possible to suppress a distortion of a shape of a steel sheet or quality unevenness caused by temperature unevenness due to rapid cooling in a neighborhood of an ejection hole at the beginning of cooling.

In the aforementioned embodiment, a case where the cooling water such as water is used as the refrigerant is described, but it should be noted that the refrigerant is not limited thereto. In other words, as the refrigerant, it is possible to use gas, vapor, or gas-liquid mixture in which water in mist form is mixed in gas.

Hereinafter, an experiment example using the hot press forming apparatus 1 of FIG. 1 will be described.

Here, as an experiment condition, with regard to a steel sheet, there is used an aluminum-plated steel sheet of 1.4 mm in sheet thickness, consisting of chemical components, in mass %, C: 0.22%, Mn: 1.2%, Cr: 0.2%, B: 0.002%, and remaining being iron and an inevitable impurity. Further, the steel sheet is heated to 900° C. and cooled to 250° C., a target temperature.

As the refrigerant, cooling water (tap water or industrial water) of 5° C. to 25° C. in temperature is used.

Figure 13:
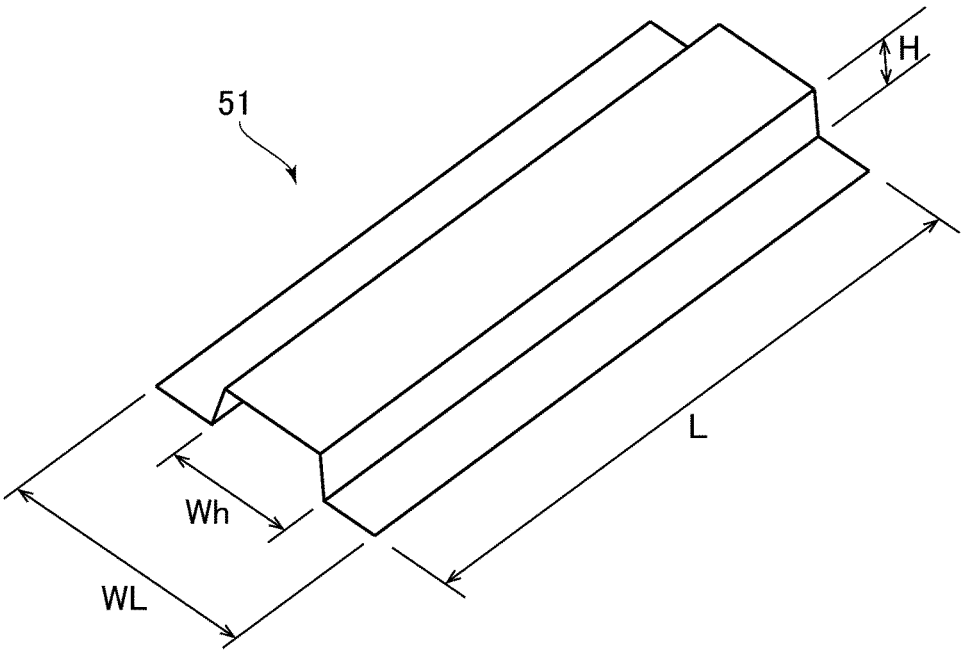
FIG. 13 is a diagram showing an example of a shape of a formed product.

A shape of a formed product by press forming is targeted to a component whose sectional rigidity is low among framework parts of an automobile. More specifically, as shown in FIG. 13, that component is a formed product 51 with a hat-shaped cross section having outward flanges, and a length L is 400 mm, a width WL is 140 mm, a height H is 30 mm, and a width Wh of a hat shape is 70 mm.

Further, in the lower mold 12, an interval I between the ejection holes 27 is 30 mm, a diameter Ds of the ejection hole 27 is 1 mm, and a diameter Da of the suction hole 33 is 4 mm. Further, a height (distance from the surface of the mold to a top surface of the projecting portion) of the projecting portion is 0.5 mm.

An ejection amount per unit time period of the cooling water is set to be changed in two stages in precooling and main cooling. In other words, from the beginning of cooling until a predetermined time period passes, the precooling is carried out in which only the opening/closing valve 25 is opened and the ejection amount per unit time period is suppressed. Thereafter, the main cooling is carried out in which the opening/closing valve 26 is also opened and the ejection amount per unit time period is increased.

time is 1 second and the main cooling time is 4 seconds is carried out. Further, "precooling time is 5 seconds, main cooling time is 0 second" indicates that the cooling is carried out for 5 seconds in a state of precooling. In other words, the ejection amount is merely reduced in the conventional method of FIG. 5.

With regard to the seven patterns in which the ratio of the ejection amount of the precooling to the ejection amount of the main cooling is changed and the six patterns in which the ratio of the precooling time period to the main cooling time period is changed, a shape accuracy of a formed product is measured for each pattern and a result is shown in Table 1.

TABLE 1

| COOLING TIME PERIOD | | | | EJECTION AMOUNT (mL/SEC BY EACH EJECTION HOLE) | | | | | | |
|---|---|---|---|---|---|---|---|---|---|---|
| EJECTION TIME PERIOD (SEC) | PRE-COOLING TIME PERIOD (SEC) | MAIN COOLING TIME PERIOD (SEC) | PRECOOLING TIME PERIOD/MAIN COOLING TIME PERIOD | PRECOOLING:MAIN COOLING 0.4:2 | PRECOOLING:MAIN COOLING 1:5 | PRECOOLING:MAIN COOLING 2:5 | PRECOOLING:MAIN COOLING 2:10 | PRECOOLING:MAIN COOLING 3:10 | PRECOOLING:MAIN COOLING 3:15 | PRECOOLING:MAIN COOLING 4:10 |
| 5 | 0 | 5 | 0 | ▼ | ▼ | ▼ | ▼ | ▼ | ▼ | ▼ |
| | 1 | 4 | 0.25 | ▲ | ∇ | ∇ | ○ | ○ | ○ | ▼ |
| | 2 | 3 | 0.67 | ▲ | ○ | ○ | ◎ | ◎ | ◎ | ▼ |
| | 3 | 2 | 1.5 | ▲ | ○ | ○ | ◎ | ○ | ○ | ▼ |
| | 4 | 1 | 4 | ▲ | ○ | ◎ | ◎ | Δ | Δ | ▼ |
| | 5 | 0 | — | ▲ | ▲ | ▲ | ▲ | ▲ | ▲ | ▼ |

In the experiment example, cooling is carried out in seven patterns of ratios of the ejection amount of the precooling to the ejection amount of the main cooling. More specifically, as shown in Table 1, the patterns are "precooling:main cooling, 0.4:2", "precooling:main cooling, 1:5", "precooling:main cooling, 2:5", "precooling:main cooling, 2:10", "precooling:main cooling, 3:10", "precooling:main cooling, 3:15", and "precooling:main cooling, 4:10". Here, "precooling:main cooling, 0.4:2", for example, indicates that the ejection amount of the precooling is 0.4 mL/sec by each ejection hole and that the ejection amount of the main cooling is 2 mL/sec by each ejection hole.

Further, an ejection time period, that is, a cooling time period by the cooling water, is set to be 2 seconds to 5 seconds within a range of 5 seconds or less where an effect of a high productivity can be obtained.

In the experiment example, the ejection time period is set to be 5 seconds, and a ratio of a precooling time period to a main cooling time period is changed by a unit of 1 second, and cooling is carried out in six patterns. More specifically, as shown in Table 1, the patterns are "precooling time period is 0 second, main cooling time period is 5 seconds", "precooling time period is 1 second, main cooling time period is 4 seconds", "precooling time period is 2 seconds, main cooling time period is 3 seconds", "precooling time period is 3 seconds, main cooling time period is 2 seconds", "precooling time period is 4 second, main cooling time period is 1 second", and "precooling time period is 5 seconds, main cooling time period is 0 second". Here, "precooling time period is 0 second, main cooling time period is 5 seconds" indicates that only the main cooling is carried out from a cooling start time to a cooling end time, without precooling. In other words, the cooling is carried out in the conventional method of FIG. 5. Further, "precooling time period is 1 second, main cooling time period is 4 seconds" indicates that the cooling where the precooling Here, a mark "▲" shown in Table 1 indicates a bad shape accuracy due to insufficient cooling. Further, a mark "▼" indicates a bad shape accuracy due to rapid cooling. A mark "Δ" indicates insufficient cooling but that whether a forming accuracy is good or bad is divided. A mark "∇" indicates rapid cooling but that whether a shape accuracy is good or bad is divided. A mark "○" indicates a good shape accuracy because of good cooling. A mark "◎" indicates that a shape accuracy is stably good because of good cooling. Here, the good shape accuracy means that an accuracy of a target dimension is ±0.5 mm or less at all positions of a formed product. Further, the shape accuracy being stably good means that an accuracy of a target dimension is ±0.4 mm or less at all positions of a formed product. On the other hand, the bad shape accuracy means that an accuracy of a target dimension exceeds ±0.5 mm in at least a part of a formed product. Further, whether the shape accuracy is good or bad being divided means that an accuracy of a target dimension exceeds ±0.5 mm in at least a part of a formed product but that a region of exceeding is clear and that it is possible to use the formed product depending on intended use of the formed product.

Based on the result shown in Table 1, in the component having the low sectional rigidity, a stable region cannot be obtained when the ejection amount of the precooling is 0.4 mL/sec by each ejection hole and 4 mL/sec by each ejection hole. In other words, in order to avoid the bad shape accuracy, it is preferable to set the ejection amount per unit time period of the precooling to be 1 mL/sec by each ejection hole to 3 mL/sec by each ejection hole. On this occasion, it is preferable to set a ratio of the ejection amount per unit time period of precooling to an ejection amount per unit time period of main-cooling to be 1:5 to 2:5.

Further, in a case where the ratio of the precooling time period to the main cooling time period is changed, a stable region cannot be obtained when the precooling time period is 0 second and the main cooling time period is 0 second. In other words, in order to avoid the bad shape accuracy, it is preferable to set the ratio of the precooling time period to the main cooling time period to be 1:4 to 4:1. In other words, when a total time period from the start of cooling until supply of cooling water is stopped is indicated as T, it is preferable to carry out the precooling between T/5 to 4T/5 from the start.

Further, in addition to the aforementioned preferable cooling condition, if the ratio of the precooling time period to the main cooling time period is further set to be 2:3 to 3:2, it is possible to make shape accuracies of all the obtained formed products good. In other words, in order for the good shape accuracy, it is preferable to set the ratio of the precooling time period to the main cooling time period to be 2:3 to 3:2.

In order to apply the aforementioned preferred condition, it is preferable that a condition below is further satisfied. In other words, it is preferable that a steel sheet is an aluminum-based plated thin steel sheet or a galvanized thin steel sheet to which plating is applied so that scale is not generated when heated. With regard to a sheet thickness, it is preferable to be a thin steel sheet of 1 mm to 2 mm which is used for a component of an automobile. Further, with regard to a temperature of the steel sheet, it is preferable that the steel sheet has been heated for quenching (generating a martensite structure by rapid cooing), to a temperature at which a ferrite structure does not precipitate (for example, 700° C.) or more to 1000° C. or less. Further, it is preferable that a refrigerant is water since water is comparatively easy to obtain, and it is preferable that its temperature is 5° C. to 25° C. being a room temperature. Further, an ejection time period, that is, a cooling time period being a total of a precooling time period and a main cooling time period is preferable to be 2 seconds or more in order to make ejected cooling water spread, and is preferable to be 5 seconds or less in order to obtain an effect of a high productivity. Note that the diameter Ds of the ejection hole 27 is preferable to be 1 mm to 4 mm in order to make the ejection amount per unit time period of the precooling be 1 mL/sec to 3 mL/sec.

Note that in a component with a high sectional rigidity, it is expected that "▲", "▼", "Δ", or "∇" changes to "○" or "◎", the stable region expanding. Further, it is confirmed in the experiment that in the component with the high sectional rigidity, the ejection time period can be shortened to 2 seconds, though not shown in Table 1.

Hereinabove, the preferred embodiment of the present invention is described, but the present invention is not limited to the aforementioned embodiment. It is obvious that a person skilled in the art can think of various modifications or corrections within the scope of spirit described in the claims, and it is a matter of course that such modifications or corrections belongs to the technical scope of the present invention.

For example, in the aforementioned embodiment, a case where the ejection hole 27 and the suction hole 33 are provided in the lower mold 12 is described, but the present invention is not limited thereto and a configuration is possible in which the ejection hole 27 and the suction hole 33 are provided in at least one of the upper mold 11 and the lower mold 12.

Further, in the aforementioned embodiment, a case where the plurality of ejection holes 27 are made is described, but the present invention is not limited to such a case but the number of the ejection hole 27 may be one depending on a size of a formed product.

INDUSTRIAL APPLICABILITY

The present invention is useful in hot press forming a thin steel sheet.

The invention claimed is:

1. A cooling method for hot press forming of a thin steel sheet in which the thin steel sheet is cooled by supplying a refrigerant to an ejection hole of a surface of a mold which ejection hole is communicated from a supply path inside the mold and by discharging the refrigerant from a suction hole of the surface of the mold in hot press forming the heated thin steel sheet, the cooling method for hot press forming comprising:

carrying out precooling in which an ejection amount per unit time period of the refrigerant from the ejection hole is suppressed; and thereafter, carrying out main cooling by increasing the ejection amount per unit time period, wherein the thin steel sheet is cooled by supplying the refrigerant to the ejection hole in a state where the heated thin steel sheet is placed on the mold and held at a bottom dead center, wherein the ejection amount per unit time period at a precooling time is 1 mL/sec to 3 mL/sec, wherein a ratio of the ejection amount per unit time period of the refrigerant from the ejection hole of the precooling time to of a main cooling time is 1:5 to 2:5, and wherein a ratio of a precooling time period to a main cooling time period is 1:4 to 4:1.

2. The cooling method for hot press forming of the thin steel sheet according to claim 1, further, wherein the ratio of the precooling time period to the main cooling time period is 2:3 to 3:2.

3. The cooling method for hot press forming of the thin steel sheet according to claim 1, further, wherein the thin steel sheet is an aluminum-based plated thin steel sheet or a galvanized thin steel sheet of 1 mm to 2 mm in sheet thickness and is heated to 700° C. to 1000° C. before the precooling, wherein the refrigerant is water of 5° C. to 25° C., and wherein a cooling time period obtained by combining the precooling time period and the main cooling time period is 2 seconds to 5 seconds.

4. A hot press forming apparatus of a thin steel sheet which cools the thin steel sheet by supplying a refrigerant to an ejection hole of a surface of a mold which ejection hole is communicated from a supply path inside the mold and by discharging the refrigerant from the suction hole of the surface of the mold in hot press forming the heated thin steel sheet, the hot press forming apparatus carrying out precooling in which an ejection amount per unit time period is suppressed, and thereafter, carrying out main cooling by increasing the ejection amount per unit time period of the refrigerant from the ejection hole, wherein the steel sheet is cooled by supplying the refrigerant to the ejection hole in a state where the heated thin steel sheet is placed on the mold and held at a bottom dead center, wherein the ejection amount per unit time period at a precooling time is 1 mL/sec to 3 mL/sec, wherein a ratio of the ejection amount per unit time period of the refrigerant from the ejection hole of the precooling time to of a main cooling time is 1:5 to 2:5, and wherein a ratio of a precooling time period to a main cooling time period is 1:4 to 4:1.

5. The hot press forming apparatus of the thin steel sheet according to claim 4, further, wherein the ratio of the precooling time period to the main cooling time period is 2:3 to 3:2.

6. The hot press forming apparatus of the thin steel sheet according to claim 4, further, wherein the thin steel sheet is an aluminum-based plated thin steel sheet or a galvanized thin steel sheet of 1 mm to 2 mm in sheet thickness and is heated to 700° C. to 1000° C. before the precooling, wherein the refrigerant is water of 5° C. to 25° C., and wherein a cooling time period obtained by combining the precooling time period and the main cooling time period is 2 seconds to 5seconds.

7. The hot press forming apparatus of the thin steel sheet according to claim 4, wherein a suction hole is made in a center of four ejection holes positioned rectangularly in the surface of the mold, and wherein a diameter of the suction hole is larger than a diameter of the ejection hole.

8. The hot press forming apparatus of the thin steel sheet according to claim 4, wherein a plurality of supply systems of the refrigerant are connected to a supply pipe of the refrigerant, the supply pipe leading to the supply path inside the mold, and wherein an opening/closing valve is provided in each of the supply systems.

9. The hot press forming apparatus of the thin steel sheet according to claim 4, wherein a flow amount regulation valve is provided in the supply pipe of the refrigerant, the supply pipe leading to the supply path inside the mold.

10. The hot press forming apparatus of the thin steel sheet according to claim 4, wherein a supply pump capable of regulating the flow amount is provided in the supply pipe of the refrigerant, the supply pipe leading to the supply path inside the mold.

* * * * *